US005129416A

United States Patent [19]

Ackroyd

[11] Patent Number: 5,129,416

[45] **Date of Patent: * Jul. 14, 1992**

[54] ANTI-SIPHON FROST-PROOF WATER HYDRANT

[75] Inventor: Rand H. Ackroyd, Methuen, Mass.

[73] Assignee: Watts Regulator Company, No. Andover, Mass.

[ * ] Notice: The portion of the term of this patent subsequent to Jul. 9, 2008 has been disclaimed.

[21] Appl. No.: 721,934

[22] Filed: Jun. 27, 1991

Related U.S. Application Data

[63] Continuation of Ser. No. 555,920, Jul. 20, 1990, Pat. No. 5,029,603.

[51] Int. Cl.[5] ..... F16K 24/02

[52] U.S. Cl. ..... 137/218; 137/302; 137/360; 137/512; 137/613; 137/625.26; 137/801

[58] Field of Search ..... 137/107, 218, 301, 302, 137/360, 512, 613, 625.25, 625.26, 798, 801, 59, 62

[56] References Cited

U.S. PATENT DOCUMENTS

| | | | |
|---|---|---|---|
| 1,647,873 | 11/1927 | Lockwood | 137/512 |
| 2,810,395 | 10/1957 | Simmons | 137/360 |
| 2,952,270 | 9/1960 | Fulton et al. | 137/360 |
| 3,106,935 | 10/1963 | Gatzke | 137/218 |
| 3,424,189 | 1/1969 | Woodford | 137/218 |
| 3,459,443 | 8/1969 | Butters et al. | 285/39 |
| 3,929,150 | 12/1975 | Flinner et al. | 137/218 |
| 3,952,770 | 4/1976 | Botnick | 137/360 |
| 4,231,387 | 11/1980 | Dixon | 137/218 |
| 4,284,097 | 8/1981 | Becker et al. | 137/218 |
| 4,316,481 | 2/1982 | Fillman | 137/302 |
| 4,475,570 | 10/1984 | Pike et al. | 137/218 |
| 4,582,081 | 4/1986 | Fillman | 137/218 |
| 4,712,575 | 12/1987 | Lair et al. | 137/218 |
| 4,909,270 | 3/1990 | Enterante, Sr. et al. | 137/218 |

OTHER PUBLICATIONS

"Frost Proof Automatic Draining Wall Hydrants", Catalog No. $-FH/FHV-1, Watts Regulator Company.

"Series 7", Catalog #ES7-10, Watts Regulator Company.

*Primary Examiner*—George L. Walton

*Attorney, Agent, or Firm*—Fish & Richardson

[57] ABSTRACT

A water hydrant defines an elongated flow passage having a water inlet and an air inlet, and a laterally extending water outlet spout disposed therebetween to define an outlet. An elongated rotatable stem is reciprocated within the flow passage, and terminates in an exterior handle. A water inlet valve is connected to the stem for control of flow from the water inlet into the passage and an air valve is connected to the stem to control inflow of air and preclude outflow of water through the air inlet. A first check valve in the spout precludes backflow of water into the passage, movement of the air valve opening the first check valve during operation of the handle. A second check valve in the spout downstream of the first check valve precludes backflow of water into the spout. A drain orifice, open to the atmosphere, extends through the spout between the check valves.

6 Claims, 4 Drawing Sheets

ANTI-SIPHON FROST-PROOF WATER HYDRANT

This is a continuation of application Ser. No. 07/555,920, filed Jul. 20, 1990, now U.S. Pat. No. 5,029,603.

BACKGROUND OF THE INVENTION

The invention relates to water hydrants of the type for extending through an outside wall of a building and having an external hand wheel or the like for turning a valve stem to reciprocate within an elongated passage. At the inner end, the passage is connected to a source of water under pressure and a water shut-off valve at the inner end of the stem, remote from the wall, engages a seat when the valve is closed. The outer end of the hydrant is typically externally threaded for attachment of a water hose.

It has been recognized that water can become trapped within the hydrant after closing of the valve. If the water freezes, as can often occur in colder climes, the hydrant can be damaged, resulting in costly repairs or replacement. There has also been recognized a danger of backflow of chemicals or other contaminants from the hose into the potable water supply, e.g. as result of back-siphonage due to loss of system pressure.

In order to protect against both of these conditions, it has been suggested, e.g. by Pike et al. U.S. Pat. No. 4,475,570, the disclosure of which is incorporated herein by reference, to include an outlet spout valving arrangement that admits air into the hydrant after each closing to release trapped water and thus avoid damage by freezing, and also that resists backflow from the outlet into the hydrant.

According to the existing standard of the American Society of Sanitation Engineers (ASSE Standard 1019), the hydrant must drain when the shut-off valve is closed, without regard for whether or not a hose is attached at the outlet. It is recognized that a hydrant constructed to meet this standard can have an increased possibility for contaminating backflow if the hose remains in place. An alternative standard proposed for consideration would require that the outlet spout valving arrangement actuate to drain the hydrant only if there is no hose attached at the outlet. This standard is intended to lessen the possibility of system contamination, but a hydrant constructed to this standard would also be more susceptible to damage due to freezing of entrapped water when the hose is left in place.

SUMMARY OF THE INVENTION

According to one aspect of the invention, a water hydrant comprises a body defining an elongated flow passage having a water inlet at a first inner end and an air inlet at a second outer end, and a laterally extending water outlet spout disposed between the first end and the second end, the outlet spout defining an outlet; an elongated rotatable stem adapted for reciprocating movement within the elongated flow passage, the stem terminating externally of the second end in an exterior operating member; a water inlet valve connected to the stem in the region of the first inner end and adapted to control flow of water from the water inlet into the elongated flow passage; an air valve connected to the stem in the region of the second outer end and adapted to control inflow of air and preclude outflow of water through the air inlet; a first check valve disposed in the water outlet spout generally adjacent the passage, the first check valve adapted to preclude backflow of water into the flow passage, the air valve comprising means for opening the first check valve during operation of the exterior operating member; and a second check valve disposed in the water outlet spout generally adjacent the outlet, downstream of the first check valve, the second check valve adapted to preclude backflow of water into the outlet spout; the body further defining a drain orifice open to the atmosphere in the water outlet spout, the drain orifice disposed between the first check valve and the second check valve.

Preferred embodiments of the invention may include one or more of the following features. The water inlet and the air inlet are disposed generally along the axis of the elongated passage. The water outlet spout is disposed closely adjacent the second outer end. The first check valve is adapted to move to an open position in response to water pressure from the passage toward the outlet spout and the second check valve is adapted to move to an open position in response to water pressure from the outlet spout toward the outlet. The means for opening the first check valve comprises a cam on the air valve operable upon opening of the air valve. Preferably the first check valve is adapted to block the drain orifice when the first check valve is open. More preferably, the check valve is adapted to open the drain orifice in response to a negative relative pressure differential condition between pressure within the passage and pressure in the outlet spout. The body further comprises an inner housing and an outer housing.

Thus there is provided an improved hydrant having an outlet spout valving arrangement which drains whenever the shut-off valve is closed, without regard for whether or not a hose is left attached at the outlet, and which further comprises a check valve disposed to protect against contaminating backflow from the outlet, in particular when the outlet spout valving arrangement is open for draining of the hydrant body and a hose is attached at the outlet.

These and other features and advantages of the invention will be seen from the following description of a presently preferred embodiment, and from the claims.

DESCRIPTION OF A PRESENTLY PREFERRED EMBODIMENT

We first briefly describe the drawings.

FIG. 1 is a perspective view of an improved, frost proof, automatic draining wall hydrant with backflow preventer, constructed according to the invention;

FIG. 2. is a longitudinal side sectional view of the improved wall hydrant of FIG. 1, with the hydrant in normal closed state;

FIG. 6 is a similar view of the improved hydrant of FIG. 1, with the hydrant in closed state and draining, and a hose connected at the outlet, while

FIG. 7 is an enlarged perspective view of the check valve disposed at the outlet spout region of the improved hydrant of FIG. 1, while

Figure 4:
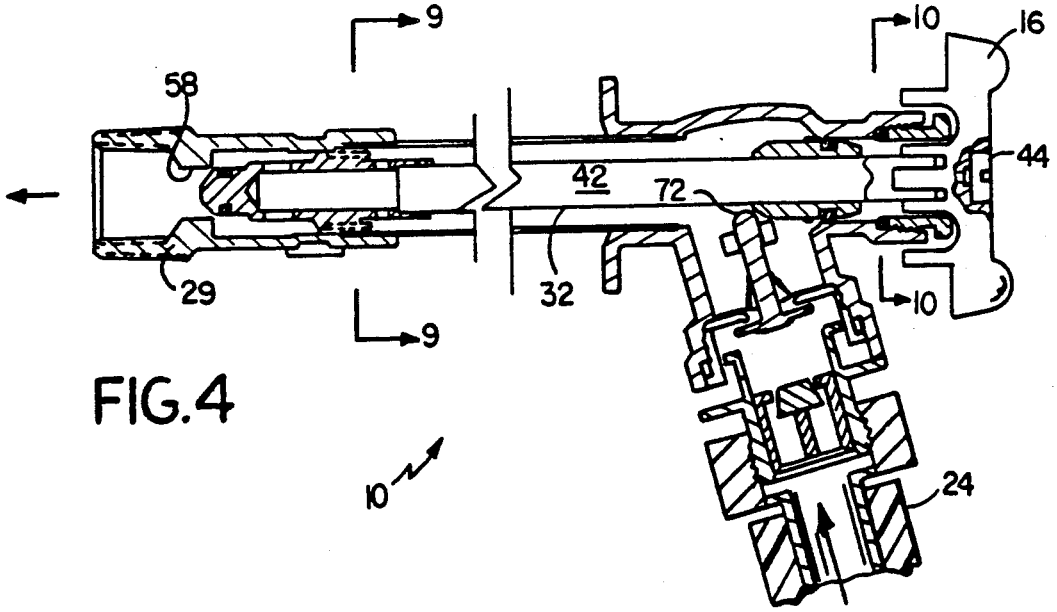
FIG. 4 is a similar view of the improved hydrant of FIG. 1, with the hydrant in normal open state.
Figure 5:
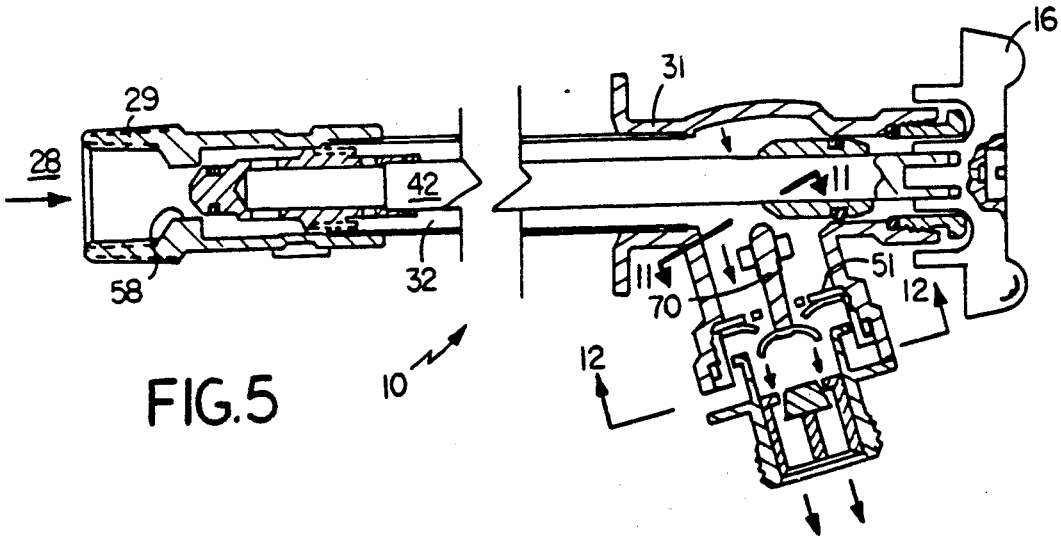
FIG. 5 is a similar view of the improved hydrant of FIG. 1, with the hydrant in normal open state with siphon or backflow condition.
Figure 9:
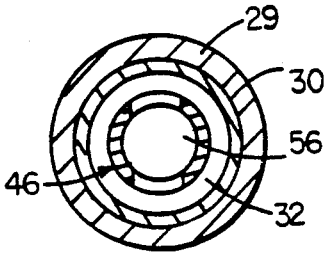
Figure 10:
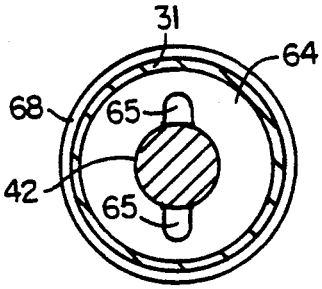
Figure 11:
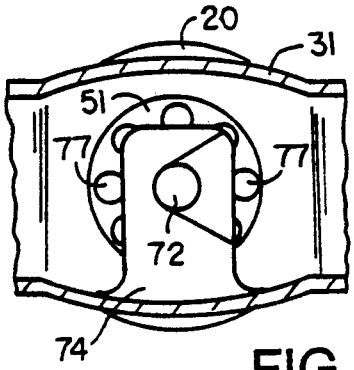
Figure 12:
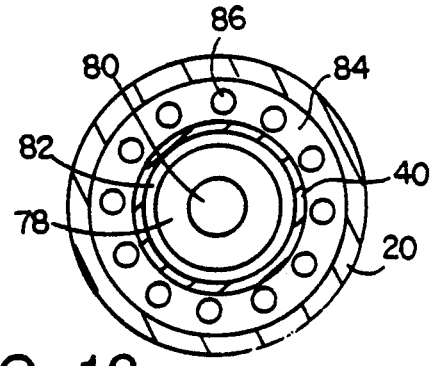

FIGS. 9 and 10 are cross sectional views of the hydrant inner and outer housing taken on lines 9—9 and 10—10 respectively of FIG. 4; and FIGS. 11 and 12 are cross sectional views of the outlet spout taken on lines 11—11 and 12—12 respectively of FIG. 5.

Figure 1:
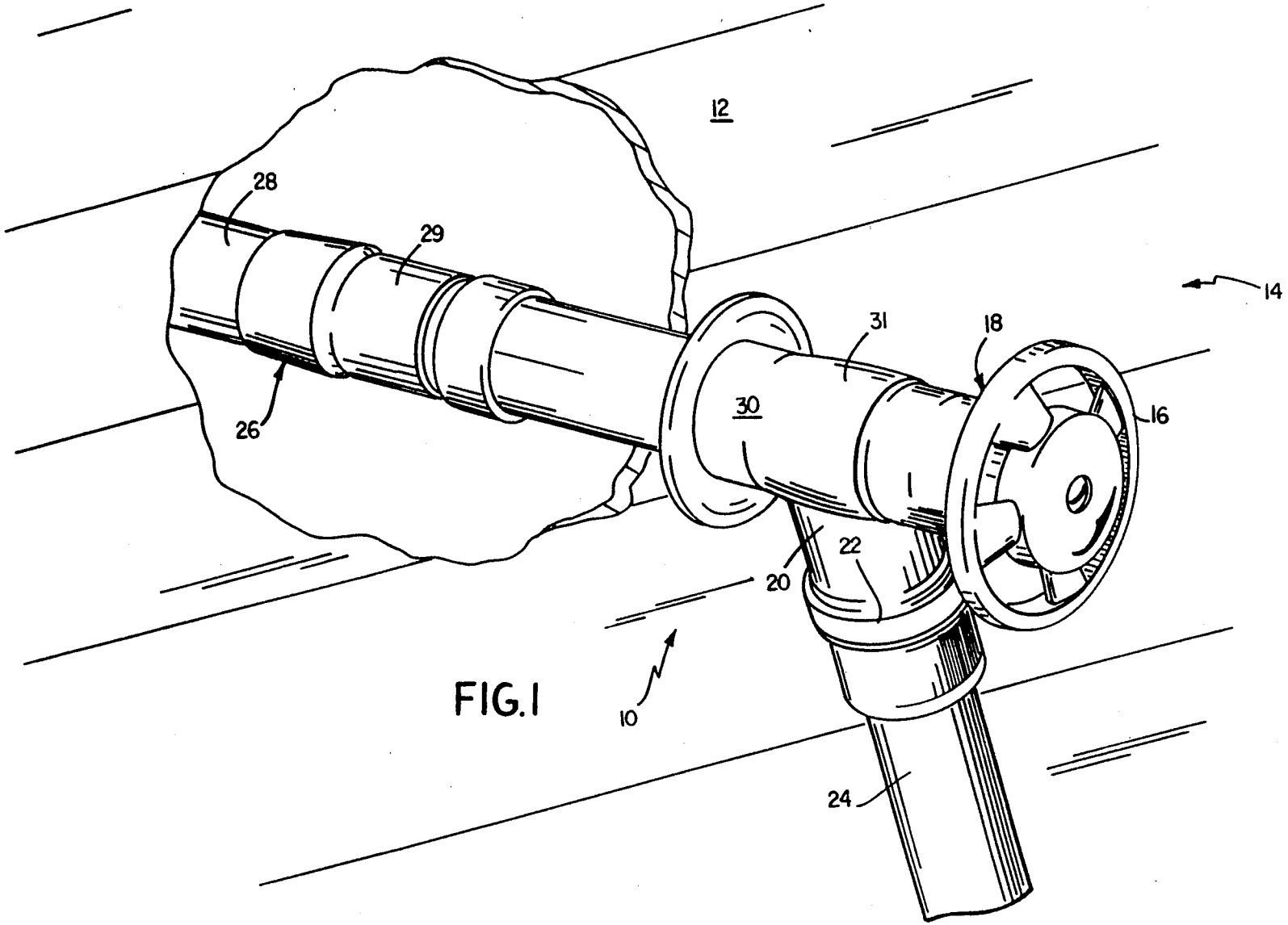

Referring to FIG. 1, a water hydrant 10 of the invention extends through the outer wall 12 of a building 14. The hydrant has an external hand wheel 16 at its outer end 18 for operation of the hydrant and an adjacent outlet spigot 20 externally threaded 22 for attachment of a hose 24. The inner end 26 of the hydrant is connected to a source 28 of potable water under pressure.

Figure 2:
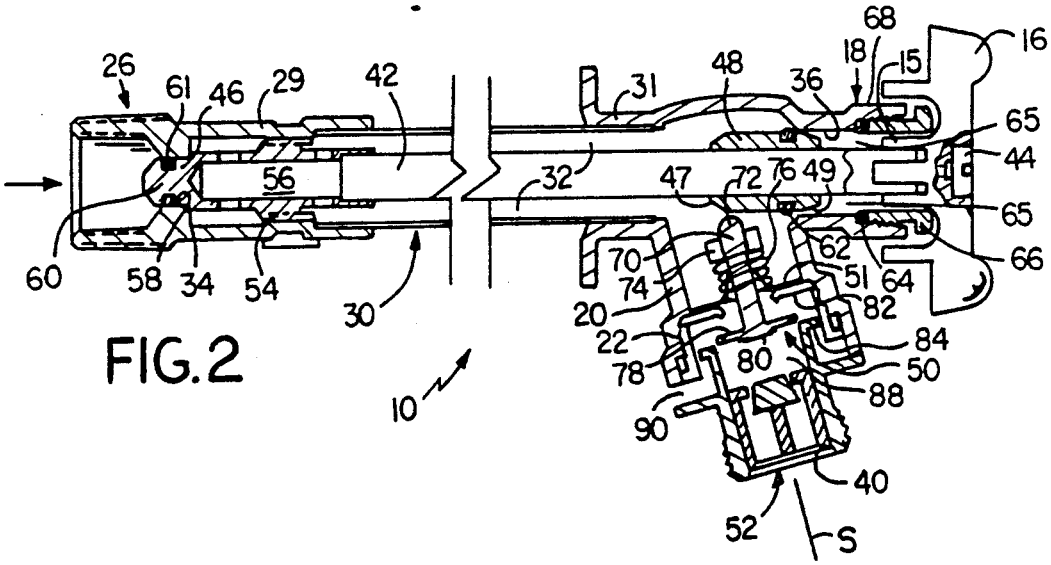

Referring now to FIG. 2, the hydrant 10 of the invention is shown in normal closed state. The hydrant 10 has a body 30 (including an inner housing 29 and an outer housing 31) which defines an elongated passage 32. The passage has a generally cylindrical water inlet bore 34 defined by the inner housing 29 at the inner end 26, and a generally cylindrical air inlet bore 36 defined by the outer housing 31 at the outer end 18. The water outlet spout 20 (also part of outer housing 31) extends laterally from the body 30, between the water inlet (bore) 34 and the air inlet (bore) 36, generally in the region of the outer end 18, and connects the passage 32 to the outlet 40. An elongated rotatable stem 42 is mounted for reciprocating movement in the passage 32, and terminates in the exterior hand wheel 16 attached to the stem 42 by metal screw 44.

A water inlet valve 46 is connected to the stem 42 in the region of the first inner end 26 (within the inner housing 29) for controlling flow of water through the inlet bore 34 into the passage 32. An air valve 48 is connected to the stem 42 in the region of the second outer end 18 (within the outer housing 31) for controlling inflow of air and precluding outflow of water through the bore 36. A first check valve 50 provided in the water outlet spout 20 adjacent the passage 32 and a second check valve 52 provided in the water outlet spout adjacent the outlet 40, downstream of the first check valve, have, among their several functions, preclusion of backflow of water from the outlet into the passage, as will be described more fully below.

Intermeshing screw threads 54 are provided between the valve 46 and the inner housing 29, and the valve has a water passage 56 (FIG. 9) by-passing the threads. The water inlet bore 34 terminates in a combination stop and valve seat 58 within the housing 29, the annular, beveled seat 58 facing toward the valve 46. The valve has a frusto-conical plug 60 shaped to complement the conical configuration of the seat 58, and a seal in the nature of an O-ring 61 is carried by the plug 60 in surrounding relationship thereto adjacent its free end.

The valve 48, in the nature of a boss surrounding and connected to the stem 42 by a cross pin (not shown), has opposed, annular, beveled ends 47 and 49, with a seal in the nature of an 0-ring 62 carried by the valve 48 in surrounding relationship thereto adjacent its end 49.

Referring also to FIG. 10, a combination stop and stem-centering, guide washer 64 surrounds the stem 42 and is provided with air inlet ports 65. The washer is clamped in place within the housing 31 by a tubular, externally threaded lockshield nut 66 surrounding the stem 42 and received within a tapped neck 68 of the housing 31. The nut in turn is adapted to receive a hub 15 on handwheel 16.

The tamper-proof first check valve 50 includes a flat, circular, relatively rigid, centrally perforated, metal plate 51 clamped across the spout 20, inwardly of the externally threaded spigot outlet 40. A stem 70, moveable along the axis S of the spout 20, has a button 72 in a guide 74 integral with the spout, the stem 70 being guided also by the plate 51 through which it projects. A conical spring 76 is coiled about the stem 70 between the plate 51 and the guide 74, and a circular row of round holes 77 (FIG. 11) in the plate 51 surrounds the stem. A circular, flexible disc 78, e.g. of rubber or the like, surrounds the stem below the plate and is held in place by a head 80 on the stem.

Figure 8:
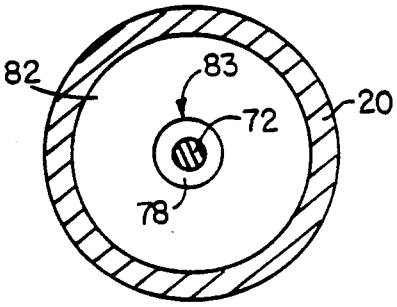
FIG. 8 is a cross sectional view of the hydrant spout taken on line 8—8 of FIG. 3.

Referring also to FIG. 8, a circular, flexible diaphragm 82, also of rubber or the like, underlies the plate 51 and has a central opening 83, of smaller diameter than that of the disc 78, and disposed in surrounding relationship to the stem 70 above the disc 78.

Referring also to FIG. 12, the spigot 20 has an external, L-shaped flange 84 provided with a row of orifices 86 surrounding the lower chamber 88 of the spigot 20, below the diaphragm 82 and open to the atmosphere by way of drain orifice 90. The flange 84 is fitted tightly into the spout 20, clamping the peripheral margins of the plate 51 and the diaphragm 82 in place.

Figure 7:
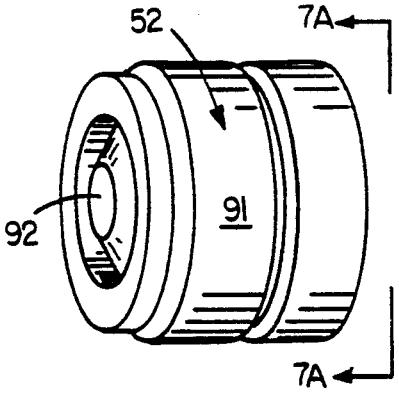
Figure 7A:
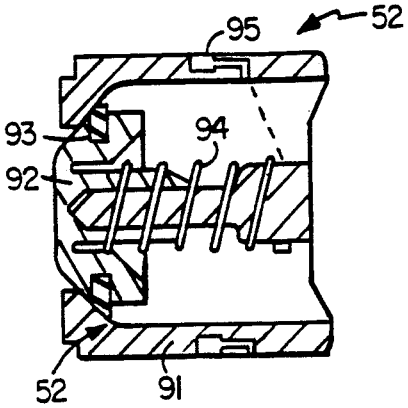
FIG. 7A is a side sectional view of the check valve taken on the line 7A—7A of FIG. 7.

Referring also to FIGS. 7 and 7A, a modular second check valve 52, positioned in the spigot 20 immediately adjacent the outlet 40 and downstream of the chamber 88, has a body 91, e.g. formed of plastic, within which there is disposed a valve element 92, mounted for movement on the axis S of the spigot. A seal ring 93 mounted on the element 92 is biased toward a sealing engagement with the body (FIG. 7A) by spring 94. An O-ring 95 disposed about the body 91 provides a water-tight seal with the spigot.

We refer now to FIGS. 2 et seq. In FIG. 2, the hydrant 10 of the invention is in normal closed position, with the handwheel 16 turned until further inward movement of the stem 42 is precluded by the plug 60 abutting the seat 58. Water flow is stopped as soon as the O-ring 61 moves past the seat 58 into water tight engagement with the surface of the bore 34, whereupon safety shut-off is established as soon as the plug is engaged upon the seat. At the same time, the air inlet valve 48 is moved inwardly, causing the bevel surface 47 to cam the button 72, and, therefore, the stem 70 and the disc 78, downwardly against the action of the spring 76, clearing the opening 83. Simultaneously, the O-ring 62 moves out of the bore 36 to permit free fluid flow therethrough. Since air is free to enter through the ports 65, water which might otherwise be trapped in the passage 32 of body 30 and the housings 29, 31 will drain freely into the outlet spout 20, seeping past the central opening 83 and the holes 77 of the plate 51, and also between the seal 93 of the valve element 92 and body 90 of the second check valve 52, for exit through the spigot outlet 40 as well as through the drain orifice 90. The bevel surface 49 affords adequate inflow of air from the bore 36.

Rotation of the O-ring 61 also serves to wipe the surface defining bore 34 during movement along the bore in a manner to clean away encrustation, corrosive elements and other foreign matter. Formation of flats and discrete areas of wear on the O-ring 61 are also avoided in this way for extended useful life. The same wiping action takes place between plug 60 and seat 58 with the same good results. Also, metal imperfections are ultimately removed to establish a good, water tight fit between the plug and seat. O-ring 62 has similar long lasting characteristics for the reasons explained, operating in the bore 36 precisely as the O-ring 61 relates to the bore 34.

In the event a hose 24 (FIGS. 1, 4 and 6) is attached at the threads 22 of the spigot 20, backflow of water therein into the hydrant passage 32 will be prevented by operation of the second check valve 52. Furthermore, any seepage that might occur by the second check valve will drain through the orifices 86 and drain orifice 90, whether or not there is a closed nozzle on the hose because the orifices are open to the atmosphere.

Figure 3:
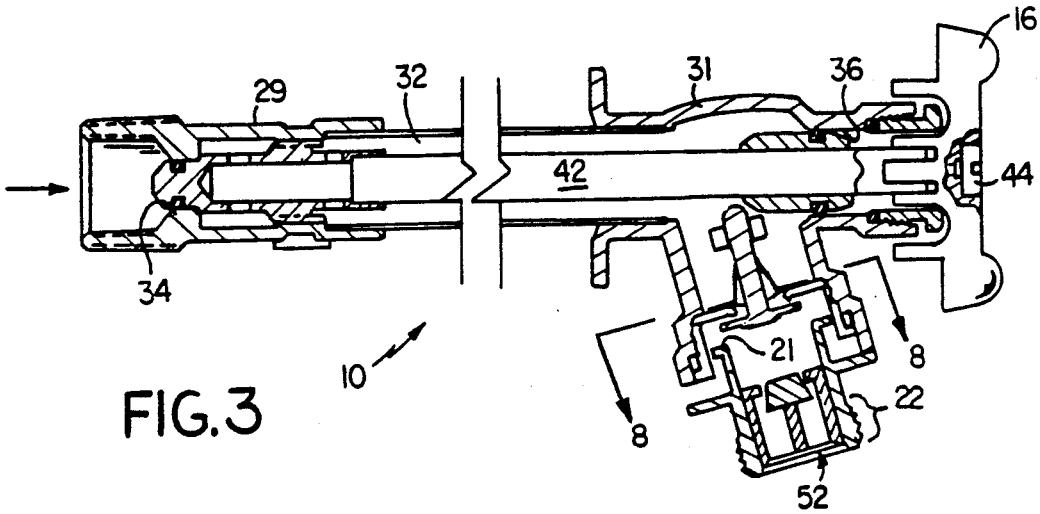
FIG. 3 is a similar view of the improved hydrant of FIG. 1, with the hydrant in transition between closed state and open state.

During initial outward movement of the stem 42 (FIG. 3), unseating the plug 60, but with the O-ring 61 still closed in the bore 34, the O-ring 62 moves into the bore 36 to not only preclude entry of air into passage 32 by way of the bore 36 via the ports 65, but also to preclude flow of water from the passage 32 past the O-ring 62. At the same time, the bevel surface 47 shifts to a position which permits the spring 76 to cause the disc 78 to snap against the diaphragm 82, clamping it against the plate 51 to close the holes 77 and the opening 83.

Referring now to FIG. 4, when the handwheel 16 is turned to draw the O-ring 62 along the bore 36 until the valve 48 approaches the washer 64, the O-ring 61 moves out of the bore 34 such that water from the bore flows between the seat 58 and the O-ring 61, through the passages 56 and 32, into the housing 31 and the spout 20. Water flowing through the holes 77 deflects the diaphragm 82 outwardly into engagement with the upper, circular rim 21 within the spigot 20, closing the orifices 86 and, at the same time, the water pressure shifts the disc 78 downwardly away from the opening 83, and shifts the valve element 92 downwardly within the body 91 of the second check valve 52 such that the water is free to flow from the spigot outlet 40.

Figure 6:
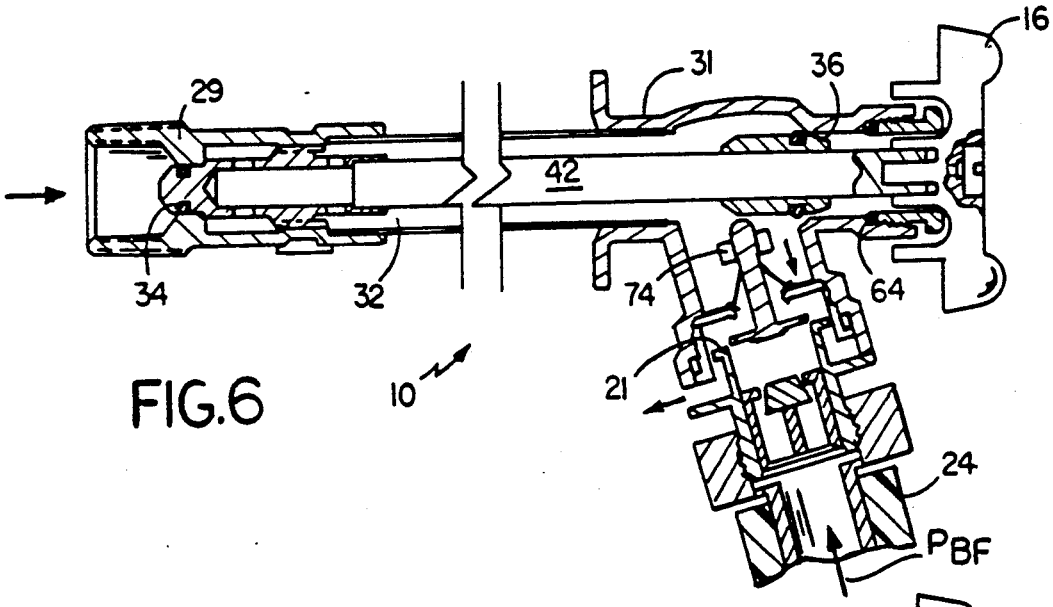
Figure 6A:
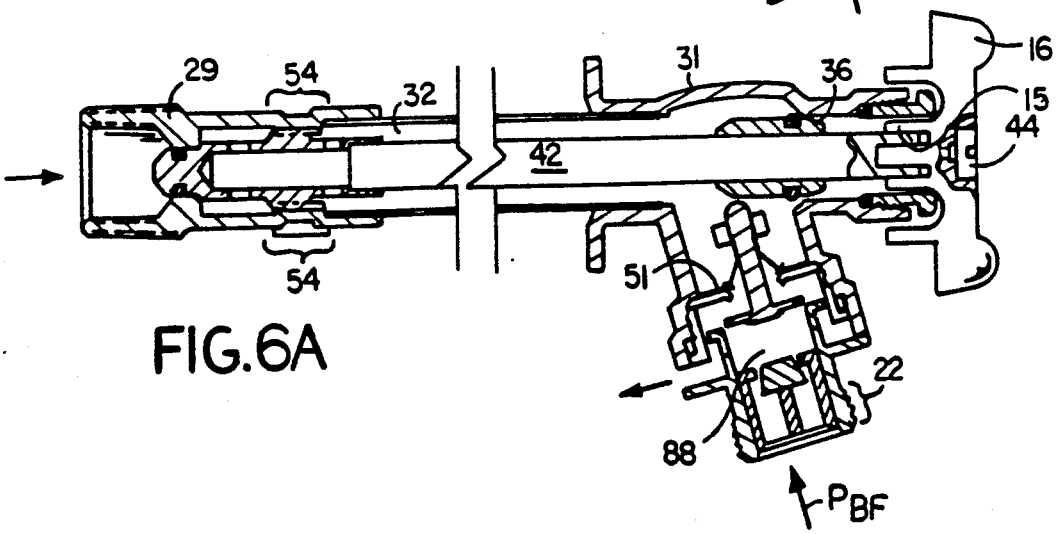
FIG. 6A is a similar view of the improved hydrant of FIG. 1, with the hydrant in closed state and draining, and no hose connected at the outlet.

FIGS. 6 and 6A illustrate the positions of component parts if the water pressure within the passage 32 drops below the water pressure downstream of the spigot outlet 40, respectively with and without a hose 24 attached. Under such a condition of negative pressure differential, the pressure (arrow $P_{BF}$) acting on the valve element 92 of the second check valve 52, aided by the spring 94, urges the seal 93 into sealing engagement with the body 91 thereby to resist backflow of water from the hose 24 into the chamber 88 of the spigot 20. Similarly, disc 78 and the diaphragm 82 therebelow, aided by the spring 76, will clamp the diaphragm 82 between the plate 51 and the disc 78 precluding backflow into the passage 32 because of closing of the opening 83 as well as the holes 77 in the plate 51. Opening of the orifices 86, 90 admits air into the chamber 88 of the spigot 20 such that any water in the hose 24 attached to the spigot 20 which can gravitate therefrom will escape. Under no circumstances then will any backflow water reach and contaminate the water supply for source 28 to the hydrant 10.

Hoses having shut-off nozzles which automatically close, as well as those which are manually closed, have common use in connection with water hydrants. It is not unusual for users to close the hydrants without opening the nozzles to drain the hoses. In that event, shown in FIG. 6, there is still no danger of freezing in the hydrant 10 because of drainage through the spigot 20 to the orifices 86, 90 as above explained, with backflow pressure in the hose prevented from acting against the hydrant by virtue of provision of the second check valve 52. Again, any seepage by the check valve, and any backflow pressure in the chamber 88, is relieved by virtue of the provision of the orifices 86, 90. This remains the case even if a portion of the hose is located above the orifices 86, 90.

Other embodiments are with the following claims.

What is claimed is:

1. A water hydrant comprising a body defining an elongated flow passage having a water inlet at a first inner end and an air inlet at a second outer end, and a laterally extending water outlet spout disposed between said first end and said second end, said outlet spout defining an outlet;

an elongated rotatable stem adapted for reciprocating movement within said elongated flow passage, said stem terminating externally of said second end in an exterior operating member;

a water inlet valve connected to said stem in the region of said first inner end and adapted to control flow of water from said water inlet into said elongated flow passage when said water inlet valve is open to said outlet;

an air valve connected to said stem in the region of said second outer end and adapted, by operation of said stem, to control inflow of air and outflow of water through said air inlet;

a first check valve disposed in said water outlet spout generally adjacent said passage, said first check valve adapted to preclude backflow of water into said flow passage;

a second check valve disposed in said water outlet spout generally adjacent said outlet, said second check valve being disposed downstream of and generally coaxial with said first check valve, said second check valve being separate and spaced from said first check valve, and said second check valve being adapted to preclude backflow of water into said outlet spout;

said hydrant further comprising means defining one or more drain orifices for permitting water to drain from said body by way of said drain orifices in a manner to prevent water from freezing within said water hydrant, while said second check valve remains closed;

said body further defining a first of said drain orifices open to the atmosphere in said water outlet spout, said first of said drain orifices being disposed between said first check valve and said second check valve;

said second check valve being mounted for operation separate and independent of said first check valve, whereby one of said check valves continues to function to preclude backflow of water in the event of failure of the other of said check valves.

2. The water hydrant of claim 1 wherein said water inlet and said air inlet are disposed generally along the axis of said elongated passage.

3. The water hydrant of claim 1 wherein said water outlet spout is disposed closely adjacent said second outer end.

4. The water hydrant of claim 1 wherein said first check valve is adapted to move to an open position in response to water pressure from said passage toward said outlet spout and said second check valve is adapted to move to an open position in response to water pressure from said outlet spout toward said outlet.

5. The water hydrant of claim 1 or 4 wherein said first check valve is adapted to block said drain orifice when said first check valve is open.

6. The water hydrant of claim 5 wherein said check valve is adapted to open said drain orifice in response to a negative relative pressure differential condition between pressure within said passage and pressure in said outlet spout.

* * * * *